United States Patent [19]

Johnson

[11] Patent Number: 4,544,137

[45] Date of Patent: Oct. 1, 1985

[54] OFFSHORE CRANE WAVE MOTION COMPENSATION APPARATUS

[75] Inventor: Paul R. Johnson, Houston, Tex.

[73] Assignee: Shell Oil Company, Houston, Tex.

[21] Appl. No.: 599,312

[22] Filed: Apr. 12, 1984

[51] Int. Cl.[4] ..... B66D 1/50

[52] U.S. Cl. ..... 254/337; 212/191; 254/277; 254/392; 254/900; 414/138

[58] Field of Search ..... 254/277, 326, 392, 900; 414/138; 212/191, 197

[56] References Cited

U.S. PATENT DOCUMENTS 4,025,055 5/1977 Strolenberg ..... 254/277
4,166,545 9/1979 Martinussen ..... 254/277 X
4,180,171 12/1979 Cunningham ..... 212/191 X
4,354,608 10/1982 Wudtke ..... 254/900 X

FOREIGN PATENT DOCUMENTS 2066762 7/1981 United Kingdom ..... 254/277

*Primary Examiner*—Stuart S. Levy
*Assistant Examiner*—Katherine Jaekel

[57] ABSTRACT

Motion compensated load-lifting apparatus for use on marine vessels. Apparatus includes a traveling weight used to maintain tension in the load-lifting member, and a locking mechanism to prevent movement of the traveling weight in one direction. The locking mechanism, such as a ratchet and pawl, can be employed to lift the load from the vessel at optimum periods of wave movement. Load direction sensing devices prevent attempted lift of the load as the vessel falls.

6 Claims, 4 Drawing Figures

FIG. 1
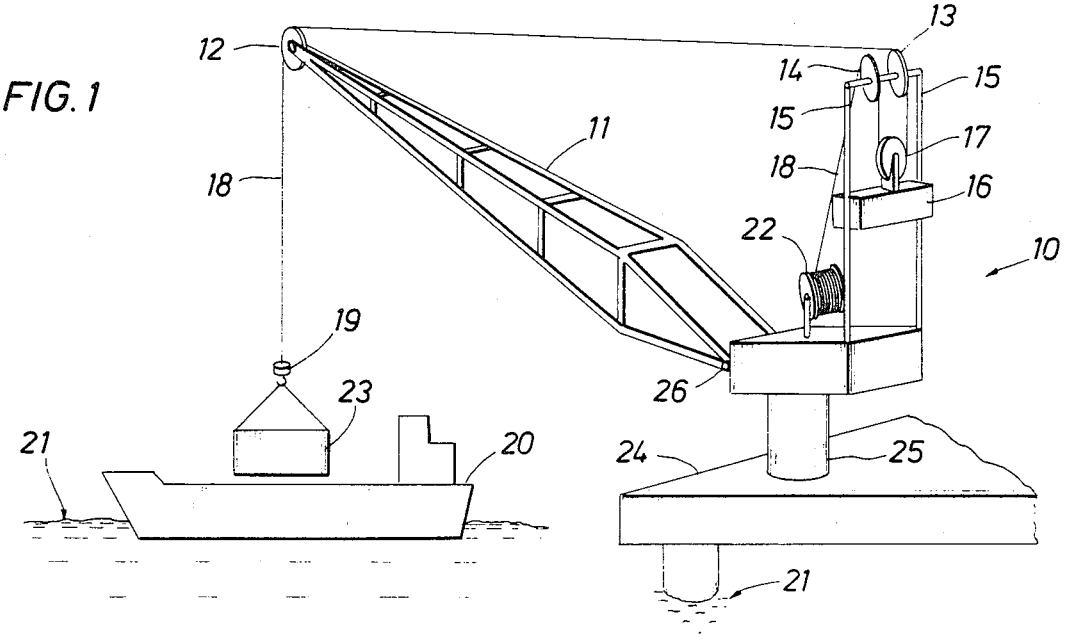
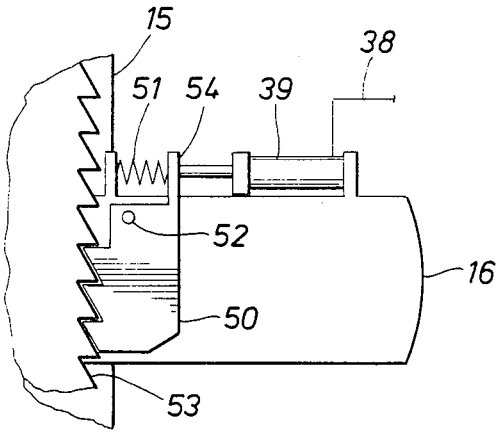
FIG. 3
FIG. 4
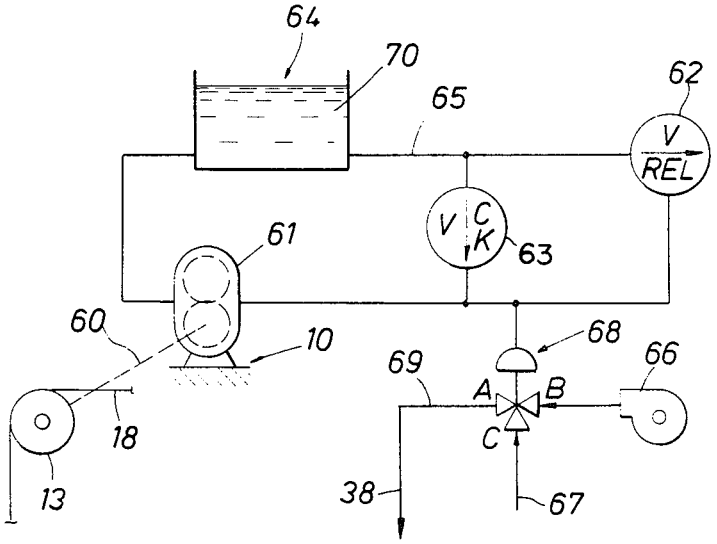

OFFSHORE CRANE WAVE MOTION COMPENSATION APPARATUS

BACKGROUND OF THE INVENTION

Field of the Invention

The present invention relates to apparatus used to compensate for relative motion between a load lifting device and the load being lifted by the device. This invention, for example, can be used in an offshore crane that loads or unloads material from a floating vessel moored nearby, where the vessel is subjected to movement caused by waves.

When the sea is rough, a floating vessel may heave more than ten feet about a reference position. Unloading or loading must often be suspended because of the hazard to personnel and equipment. The relative motion between, for example, the hook connected to a winch in a crane mounted on an offshore structure and the deck of the vessel moored adjacent the structure, not only makes it difficult to attach a load to the hook, but also makes it dangerous to raise or to lower the load. For example, if a load of drill pipes or casing are attached to the hook and the lifting line is tensioned when the deck of the vessel is falling, the deck may subsequently rise faster then the rate at which the load is raised and the vessel would then collide with the load probably causing drilling pipes and casing to fall back onto the vessel. Moreover, once the hook has been attached to the load the vessel may fall beyond a point where the slack in the line is taken up thereby causing a sudden shock loading to be applied to the crane. Such a shock loading is deleterious to the crane and increases the hazard of load swing and hence collision between the load and the vessel or even personnel.

The apparatus of the present invention seeks to reduce, or to eliminate the latter problems whereby, for example, a supply vessel moored adjacent an offshore structure can be unloaded, or loaded in conditions during which work is normally suspended. This saves time and considerable expense in offshore drilling because work is normally suspended in foul weather when supplies cannot be loaded onto a rig.

The invention provides apparatus for use either in raising a load in a condition of relative motion between the apparatus and a support for the load, or in lowering a load in a condition of relative motion between the apparatus and a support for receiving the load. The apparatus comprises primary drive means for withdrawing, or for advancing a load supporting member such as line means, relative to the location of the load, as is also disclosed in U.S. Pat. No. 4,025,055, and tensioning means to apply and to maintain a tension in said load supporting member to compensate for said relative motion when the load is positioned on said support and is attached to said load supporting member.

The tensioning means can be arranged between the primary drive means and the load supporting member. For example, when the load supporting member comprises a line, a section of the line can be entrained about a pulley mounted on a traveling weight forming the tensioning means which is positioned between the primary drive winch and the load lifting block. The tensioning means is passively applied, responding only to line tension and gravity, not requiring external active control or power. Use of a suspended weight introduces a "zero-stiffness" element in the lifting means, which renders the lifting means totally compliant to motions of the load prior to lifting. Preferably, the tensioning means also comprise means to apply different tensions to the load supporting member, such as by adding or removing weight from the tensioning means.

A selectable unidirectional locking device such as a ratchet and pawl mechanism is provided to cause the tensioning means to become inactive in one direction of motion. This immobilizes the "zero-stiffness" element or traveling weight in the lifting system and allows the actual lift to proceed in a conventional fashion. The advantage of a ratchet and pawl mechanism is that the pawl can, if selected, travel freely over the teeth of the ratchet when a load is displaced in one direction (for example, when the deck of a supply vessel is rising) and it will then engage the teeth when the load moves in opposite direction (for example, when the deck of the vessel falls). This insures that the primary drive is effective at an optimium point during the relative motion (for example, at or near the crest of the vessel's motion). A further advantage is that the pawl is automatically disengaged if the load is again supported (for example, if the deck of the vessel meets the load when the deck rises faster than the load is being raised).

Prior art tensioning means comprise active control systems which operate on a "low-compliance" lifting system without modifying the inherent stiffness of that system. As such, they require a reliable source of substantial hydraulic power for their operation, since the disclosed devices usually include a piston and cylinder, or a rotary hydraulic drive coupled to a drum which stores a length of line. Failure of these tensioning devices would, at a minimum, make vessel loading or unloading impossible during adverse sea state conditions. But the major Problem of these hydraulically-actuated tensioning means is their requirement for applying a pretensioning load over a wide range of rapidly changing line velocities. In "low-compliance" stiff systems, this requires precise positioning, rapid control response and considerable power. In addition, the failure of any part of these complex systems during loading or unloading operations could cause loss of control over the load.

A device is contemplated which would prevent actuation of the tensioning means' ratchet and pawl device when the load is on the vessel's deck and the vessel is falling into the trough of a wave. If the operator activates the ratchet and pawl device as the vessel falls in the trough of a wave, the load will become suspended over the deck of the vessel. When the vessel subsequently rises, the load and vessel deck may impact. A device therefore need be employed which eliminates the possibility of vessel and load damage caused by operator misjudgment during operation of the tensioning means' unidirectional locking device.

SUMMARY OF THE INVENTION

The present invention obviates the above problems by providing an apparatus which utilizes a traveling weight to tension the load attachment means, and in addition employs a load direction sensing device to prevent improper operation of the traveling weight ratchet and pawl mechanism. Since the traveling weight depends on gravity for its operation, its reliability is inherently greater than that of a hydraulically powered tensioning system. The load direction sensing device coupled to the ratchet and pawl actuation system mounted on the tensioning means, prevents pawl actuation when the load is on the vessel's deck, and the vessel's deck is falling, thereby correcting the problem of untimely ratchet and pawl engagement. This device may also be used to automatically engage the pawl with the ratchet if the vessel and load are heaving upwards.

The invention therefore comprises a traveling weight which operates in combination with a load direction sensing device. The traveling weight, due to its vertical movement, applies a continuous tension to the load attachment means and subsequently the load, as the vessel rises and falls. In the preferred embodiment, the traveling weight may be adjusted to apply varying tensions to the load attachment means by the addition or removal of weight elements. This traveling weight comprises a horizontal beam slideably engaged with two parallel vertical tracks, being rotatably connected to the line means by use of a pully mounted on the beam. A pawl mechanism is mounted on each end of the beam, and selectively engages a cooperating ratchet, mounted on the sides of each vertical track.

In controlling the operation of the pawl mechanism, actuation devices for the pawl mechanism are also mounted on the beam, and receive actuation signals from a load direction sensing device. This device senses the direction of the load movement and prevents the tensioning means from becoming unidirectionally locked to the tracks as the vessel and load fall downward, and the traveling weight moves upward. In the preferred embodiment, a hydraulic motor is operatively connected to the crane gantry pulley located nearest the load attachment means. As the load rises and falls on the vessel's deck, the pulley rotates clockwise and counterclockwise. The hydraulic motor's output varies due to this change in pulley direction, and the output during the direction of pulley rotation when the load is falling is used to prevent the pawl mechanism from engaging the ratchet. This obviates the problem described above where the load becomes suspended above the vessel's deck, and subsequently impacts the deck as the vessel rises on the next wave.

Accordingly it is an object of the invention to provide an offshore crane with a safe, reliable motion compensation apparatus, which includes a control system that is not susceptible to operator error. Improvements over the prior art in this motion compensation apparatus include line tensioning means which comprise a horizontal weighted beam slideably engaged with two vertical tracks, and a load direction sensing device which permits the beam to be unidirectionally locked to the vertical tracks during optimum periods of vessel and load movement.

A further object of the invention is to provide an offshore crane with wave motion compensation apparatus which is simple in design, rugged in construction, and economical to manufacture.

The various features of novelty which characterize the invention are pointed out with particularity in the claims next to and forming a part of this disclosure. For a better understanding of the invention, its operating advantages and specific object obtained by its uses, reference should be made to the accompanying drawing and descriptive matter in which there are illustrated preferred embodiments of the invention.

BRIEF DESCRIPTION OF THE DRAWING

FIG. 1 is a schematic representation of an offshore floating vessel unloading or loading operation, in which the present invention, the wave motion compensation apparatus, is shown incorporated with a crane mounted on an offshore platform.

FIG. 3 shows an enlarged detail of the ratchet and pawl mechanism.

FIG. 4 is a schematic representation of the load direction sensing device.

DESCRIPTION OF THE PREFERRED EMBODIMENT

Figure 2:
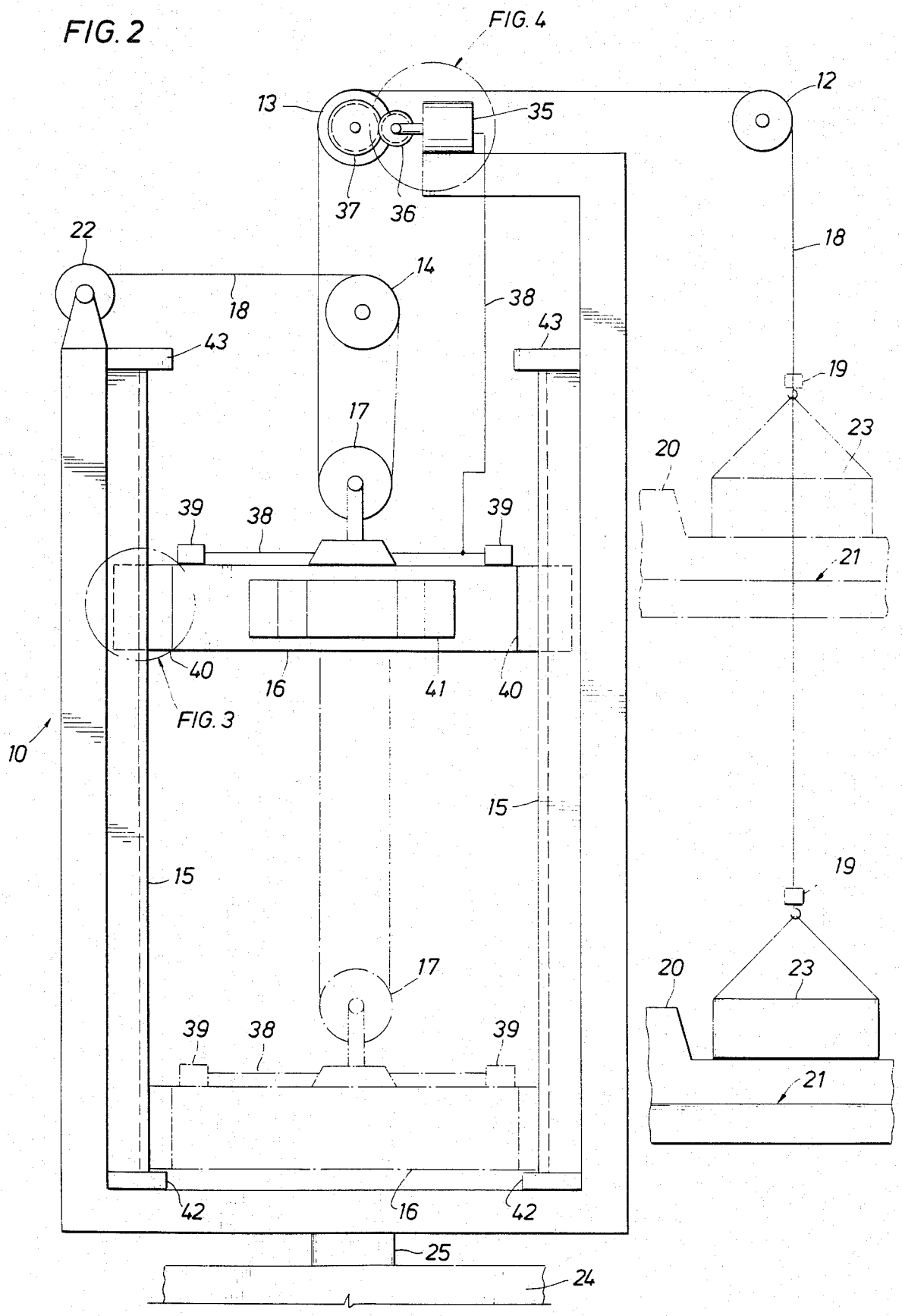
FIG. 2 is a schematic representation of the motion compensating apparatus.

FIG. 1 shows an offshore vessel 20 moored adjacent an offshore platform 24, the vessel 20 floating in a body of water 21. A load 23 is being loaded or unloaded from the vessel 20. Load attachment means 19, such as a hook suspended from a lifting block, are secured to the load 23. Line means 18, such as a steel cable are connected to the load attachment means 19, and by active engagement with pulleys 12, 13, 17, 14 mounted on the offshore crane 10 are engaged with the winch means 22. The winch means 22 supplies the power necessary to raise or lower the load 23 from the vessel 20. Between the winch means 22 and the load attachment means 19, the steel cable becomes rotatably engaged with cable tensioning means such as a traveling weight 16 in the preferred embodiment. This weight 16 moves vertically between two vertical track means 15, such as two vertically mounted structural columns located on top of the crane 10 structure. As the load 23 moves upward and downward on the vessel 20 deck, the traveling weight 16 moves downward and upward respectively, and therefore "tracks" the motion of the load 23 on the vessel 20 deck, and at the same time applies a tension to the line means 18.

The line means 18 is supported by the crane boom pulley 12, gantry pulley 13, tensioning means pulley 17, gantry pulley 14 and winch means 22. The offshore crane 10 may swivel about its mounting base 25 during loading operations, and the crane boom 11 may also rotate about the crane boom pivot point 26 during load 23 placement operations. The angle of the crane boom 11 relative to the crane 10 may be controlled by the crane operator by positioning cables (not shown).

FIG. 2 shows the crane motion compensation apparatus in more detail. The tensioning means is shown in the preferred embodiment as a traveling weight 16 which comprises a horizontal beam, slideably engaged at each end by vertical track means 15 such as structural members. These members confine the ends of the traveling weight 16, and thereby limit its movement in other than a vertical direction. The traveling weight 16 may incorporate rollers or bearings at its ends to assist its vertical travel within the vertical tracks. It is also recognized that other combinations of traveling weights 16 and their associated guide systems may be used to obtain the equivalent mechanical result of tensioning the line means 18 during load 23 movement. A single weight and track system, or a multiplicity of weights and tracks may be used. Adjustable weight means 41 such as removable weights may be used to vary the tension in the line means 18. The traveling weight 16 should be heavy enough to overcome undesireable acceleration and friction effects associated with load 23 movement on the vessel 20 deck, yet be light enough to prevent inadvertant lift off of a load 23 from the vessel 20 deck. Considering these limitations and the normal offshore package weight, a value of 2000 pounds should be nominally selected for the traveling weight 16. This weight may be adjusted for different anticipated loads by change in the adjustable weight means 41.

The traveling weight 16 is rotatably attached to the line means 18 by a traveling weight pulley 17 mounted on the upper surface of the traveling weight 16. It is recognized that other pulley 17 mount arrangements may also be used, such as pulley 17 mount placement within the framework of the traveling weight 16. Although a single pulley system is disclosed in the preferred embodiment it is well recognized that the apparatus will operate with other equivalent combinations of pulley and cable systems as are well known to the art.

Line direction sensing means 35 are shown operatively engaged to gantry pulley A 13, and will permit actuation of the undirectional locking means 40, while the load 23 is moving in the upward direction. The directional sensing means 35 can be operatively placed at different points of engagement with the line means 18 and its associated supporting pulleys 12, 13, and still function properly. For example, the directional sensing means 35 may be connected directly to the line means 18 before the line means 18 contacts the tensioning means pulley 17, or it may be connected to the crane boom pulley 12. FIG. 2 shows the directional sensing means 35 connected by gear engagement to gantry pulley 13, though in the preferred embodiment (FIG. 4) the directional sensing means 35 are coupled to the axle 60 of gantry pulley 13.

Signal transmission means 38, such as electrical or hydraulic conduit, or mechanical linkage, transmit a signal from the directional sensing means 35 to the actuation means 39 of the unidirectional locking means. The actuation means 39 may be comprised of a hydraulic piston and cylinder arrangement well known to the art. The signal transmitted by the signal transmission means 38 prevents crane 10 operator actuation of the unidirectional locking means 40 while the load 23 on the vessel 20 deck falls, as explained below. The unidirectional locking means 40, when actuated permits vertical descent of the traveling weight 16 between the vertical track means 15, but prevents vertical ascent of the traveling weight 16. The unidirectional locking means 40 may be comprised of any mechanical device which accomplishes this result, such as a ratchet 53 and pawl 50 mechanism (FIG. 3), or braking elements actuated only in one direction of traveling weight 16 movement (not shown).

The traveling weight 16 in FIG. 2 is shown locked to the vertical tracks 15 as the load 23 is lifted from the vessel 20 deck. The traveling weight 16 is shown in phantom at its lowest expected position as the vessel 20, shown in phantom, raises to its highest elevation on a wave crest. The vertical tracks 15 therefore need only be longer than the anticipated traveling weight 16 movement caused by any anticipated vessel 20 movement. Travel stops 42, 43 made from resilient material may be used at both ends of the tracks to absorb inadvertent traveling weight 16 impact with the crane 10. Travel stops 42, 43 are provided at each end of the vertical tracks 15 to reduce shocks during prelift of the load 23, as described below, and also to act as a safety back-up in case of unidirectional locking means 40 failure.

In operation, the load attachment means 19, such as a hook, is positioned over the vessel 20, then lowered to the vessel 20 deck by reeling off line means 18 from the winch 22. The traveling weight 16 rests at the base of the vertical tracks 15. The load 23 is then attached to the load attachment means 19. Slack in the line means 18 is taken up by reeling cable in on the winch 22, and the traveling weight 16 is lifted vertically upward from the base of the track 15. Some minor impact of the traveling weight 16 with the resilient means 42 loads may be experienced as slack is taken up. The traveling weight 16 begins to "track" the vessel 20 movement. The line means 18 is further taken up by the winch 22 until the traveling weight 16 tracks between the top and bottom of the vertical tracks 15. As the vessel 20 rises on the face of a wave, the crane 10 operator initiates the lift by actuation of the unidirectional locking means 40, and simultaneous application and of power to the winch 22, causing the winch 22 to reel in cable. Since the lift is made as the vessel 20 rises, the traveling weight 16 descends as the lift begins. As the winch 22 accelerates, the traveling weight 16 slows its descent. At the load 23 lift-off point from the vessel 20 deck, the winch 22 reels in cable at the same rate as the vessel 20 deck rises, and the traveling weight 16 stops its downward movement. When the cable reel-in velocity exceeds the vessel 20 deck velocity, the traveling weight 16 unidirectional locking means 40 prevent upward movement of the weight 16, and the load 23 is lifted off the vessel 20.

As the load 23 is set on the platform 24, the cable tension decreases and the traveling weight 16 descends to the base of its track 15. The crane 10 operator then disengages the traveling weight 16 unidirectional locking means 40, prior to commencement of another vessel 20 unloading operation.

A feature of this wave motion compensation apparatus is its ability to deal with false wave crests during vessel 20 unloading. If the load 23 liftoff occurs during a wave false crest, and the load 23 subsequently recontacts the deck, the traveling weight 16 descends, absorbing any slack cable. As the true wave crest approaches, load 23 liftoff proceeds as before.

The crane 10 operator is automatically prevented from actuation of the unidirectional locking means 40 when the vessel 20 falls, due to an automatic override signal from the directional sensing means 35.

This prevents the crane 10 operator from deliberately raising the load 23 over the vessel 20 deck while the vessel is falling in a wave trough. It is envisioned, of course, that the operator may want to "lockout" this override feature during the occurence of unforseen loading operations, and means should be provided to allow the operator this option.

The directional sensing means 35, in supplying this operator override signal, therefore prevents the actuation of the unidirectional locking means 40, when the traveling weight 16 is traveling in an upward direction. This avoids impact loading of the crane and potential damage to the wave motion, compensation apparatus. Once the traveling weight 16 is unidirectionally locked to the tracks 15, the directional sensing device can not cause their disengagement, as explained further below.

Transfer of a load 23 to the vessel 20, from the platform 24, can be accomplished as follows. The load 23 is attached to the load attachment means 19, such as by slings well known to the art. The line means 18 are then reeled in by the winch 22, and the traveling weight 16 is raised upwards between the vertical tracks 15. The traveling weight 16 unidirectional locking means 40 are then actuated and the load 23 is lifted off the platform 24. The weight of the load 23 maintains the traveling weight 16 stationary against the unidirectional locking means 40. The load 23 is positioned over the vessel 20, and lowered toward the vessel 20 deck as a wave crest beneath the vessel 20.

As the load 23 contacts the vessel 20 deck, the tension in the line means 18 decreases below the weight of the traveling weight 16, and the traveling weight 16 moves downward between the tracks. This downward movement will allow the operator to de-actuate the unidirectional locking means 40, thereby allowing the traveling weight 16 to travel upward in response to downward movement of the load 23 on the vessel 20 deck. Of course, it is also recognized that the directional sensing means 35 may perform this function automatically, or the unidirectional locking means 40 may be designed to de-actuate automatically upon downward movement of the traveling weight 16.

The above operations describe load transfer between a vessel 20 and platform 24, where the load 23 is heavier than the traveling weight 16. To transfer lighter loads 23, the weight of the traveling weight 16 may be decreased by removal of the adjustable weight means 41, and if necessary the adjustable weight means 41 may be added to the load 23, or the traveling weight 16 may remain locked to the tracks 15 while loading and unloading operations are conducted.

FIG. 3 shows in more detail the preferred embodiment of the unidirectional locking means 40. A ratchet 53 and pawl 50 mechanism is shown, as is well known to the art. The pawl 50 is carried by the traveling weight 16, and the ratchet 53 device is incorporated into the vertical track means 15. It is recognized that any other ratchet 53 and pawl 50 mechanism may be used at the junction of the traveling weight 16 and the vertical track 15, as long as the cooperating elements formed by this mechanism are arranged to prevent upward movement of the traveling weight 16 when actuated. In the preferred embodiment the spring means 51, such as a spring well known to the art, the pawl arm 54, and the actuation means 39, such as a hydraulic piston and cylinder well known to the art, are arranged such that loss of power to the actuation means 39 will cause the ratchet 53 and pawl 50 to engage. Signal transmission means 38, such as mechanical linkage or hydraulic conduit from the directional sensing means 35, are coupled to the actuation means 39 in order to supply power to the actuation means 39. In the present embodiment unidirectional locking means 39 are carried on opposite ends of the traveling weight 16, though it is recognized that other combinations may be used to accomplish the same mechanical effect.

FIG. 4 shows in detail the directional sensing device 35. In the preferred embodiment, a hydraulic motor 61, as is well known to the art, is connected to the axle 60 which supports gantry pulley A 13. As the vessel 20 and load 23 fall downward from a wave crest, the line means 18 will cause the pulley 13 to rotate clockwise. This clockwise rotation causes the hydraulic motor 61 to pump hydraulic fluid 70 through hydraulic conduit 65 to the diaphram actuator of the three way control valve 68, as is well known to the art. Pressure on the actuator of this valve 68 causes the main hydraulic power supply pressure source 66 to become directed from port B to port A of the valve 68. The pressure source 66 is thereby directly connected via the signal transmission means 38, to the actuation means 39 for the unidirectional locking means 40, (FIG. 3). The actuation means 39 overcomes the force of the spring means 51 on the pawl arm 54, which causes the pawl 50 to pivot counterclockwise about the pawl pivot 52, which thereby maintains the pawl 50 in a state of disengagement from the ratchet 53 (FIG. 3). This prevents engagements of the traveling weight 16 with the vertical tracks 15 as the load 23 and vessel 20 move downward from the crest of a wave.

While this valve 68 has hydraulic motor 61 pressure applied to its actuator, manual signals from the crane 10 operator can not reach the actuation means 39. Hydraulic fluid 70 discharged from the hydraulic motor 61 is prevented from return to the hydraulic reservoir 64 by a check valve 63, and a pressure relief valve 62 protects the valve 68 diaphram actuator from overpressure.

As the vessel 20 and load 23 rise upwards, the line means 18 causes the gantry pulley A 13 to rotate counterclockwise. The hydraulic motor 61 recirculates fluid through the check valve 63 back to the hydraulic reservoir 64. No pressure is applied to the valve 68 diaphram, and manual signals 67 from the operator are now allowed to pass through the valve 68 via the signal transmission means 38, to the actuation means 39 as is well known in the art. This allows the operator to engage the traveling weight 16 to the vertical tracks 15 at an optimum point as the vessel 20 and load 23 rise on a wave crest. The manual signals 67 may also be used to prevent further connection of the pressure source 66 to the actuation means 39 for the unidirectional locking means 40, (FIG. 3), to prevent disengagement of the unidirectional locking means 40 as the vessel 20 and load 23 fall downward in a subsequent wave trough, by means well known to the art.

It is recognized that other combinations of devices may be used to accomplish the same mechanical result as described above. The directional sensing means 35 may be connected to the crane boom pulley 12, or may be engaged directly with the line means 18. The control system which encompasses the directional sensing means 35 may include redundant devices to prevent adverse consequences upon failure of one directional sensing means 35. The directional sensing means 35, signal transmission means 38, and actuation means 39 may be fabricated from electrical components, or from mechanical linkage components well known to the art, instead of the hydraulic component system disclosed above.

I claim as my invention:

1. Wave motion compensation apparatusm, for use in an offshore crane, comprising:

winch means carried by said crane, line operatively connected to said winch means, load attachment means operatively connected to said line, a traveling weight operatively connected to said line, a vertical track operatively engaged and positioned adjacent said traveling weight in sliding engagement therewith, unidirectional locking means having a first and a second portion, one of said portions operatively connected to said traveling weight and the other of said portions operatively connected to said vertical track, actuation means for said unidirectional locking means, said actuation means carried by said traveling weight and operatively engaging one of said portions of said unidirectional locking means, line direction sensing means carried by said wave motion compensation apparatus, operatively engaging said line means, for selectively generating a line direction output signal indicative of the direction of movement of said line, and signal transmission means operatively connected between said line direction sensing means and said actuation means for transmitting said line direction output signal of said line direction means to said actuation means.

2. The apparatus of claim 1 wherein said first portion of said unidirectional locking means further includes a pawl, and said second portion of said unidirectional locking means further includes a ratchet, said ratchet operatively engageable with said pawl.

3. The apparatus of claim 1 wherein said signal transmission means further includes electrical conduit to transmit an electrical signal from said line direction sensing means to said actuation means for said unidirectional locking means.

4. The apparatus of claim 1 wherein said signal transmission means further includes hydraulic line to transmit a hydraulic signal from said line direction sensing means to said actuation means for said unidirectional locking means.

5. The apparatus of claim 1 wherein said signal transmission means further includes mechanical linkage to transmit a signal from said line direction sensing means to said actuation means for said unidirectional locking means.

6. The apparatus of claim 1 wherein said traveling weight includes adjustable weight means carried by said tensioning means.

* * * * *